US005561869A

United States Patent [19]

Sarel

[11] Patent Number: 5,561,869

[45] Date of Patent: Oct. 8, 1996

[54] SHOWER MOUNTED BODY WASHER

[76] Inventor: Scott Sarel, 3291 NW. 66th St., Ft. Lauderdale, Fla. 33309

[21] Appl. No.: 276,053

[22] Filed: Jul. 15, 1994

[51] Int. Cl.[6] ..... A47K 7/02

[52] U.S. Cl. ..... 4/606

[58] Field of Search ..... 4/606; 15/22.1, 15/88.2, 88.3, 97.1

[56] References Cited

U.S. PATENT DOCUMENTS

| | | | |
|---|---|---|---|
| 1,758,115 | 5/1930 | Kelly . | |
| 2,697,839 | 12/1954 | Jackson . | |
| 2,730,737 | 1/1956 | Herman . | |
| 3,074,088 | 1/1963 | Williams . | |
| 3,724,760 | 4/1973 | Smith . | |
| 3,875,604 | 4/1975 | Wurn et al. . | |
| 4,008,503 | 2/1977 | Tharp | 15/88.3 |
| 4,151,623 | 1/1979 | Steere | 15/21.1 |
| 4,171,094 | 10/1979 | Halfen . | |
| 4,228,557 | 10/1980 | DeVivo et al. . | |
| 4,271,543 | 6/1981 | Martin . | |
| 4,696,068 | 9/1987 | Kenner . | |
| 4,704,756 | 10/1987 | Williams et al. | 15/22.1 X |
| 4,841,590 | 6/1989 | Terry et al. . | |
| 4,943,018 | 7/1990 | Glaser et al. . | |
| 5,065,463 | 11/1991 | Le | 4/606 |
| 5,065,942 | 11/1991 | Shannon . | |
| 5,072,480 | 12/1991 | Peters et al. . | |
| 5,153,962 | 10/1992 | Ritter . | |
| 5,228,165 | 7/1993 | Westbury et al. . | |
| 5,339,469 | 8/1994 | Gilles | 4/606 X |
| 5,345,640 | 9/1994 | Goss | 4/606 X |

FOREIGN PATENT DOCUMENTS

| | | | |
|---|---|---|---|
| 2347001 | 9/1977 | France | 4/606 |
| 2426432 | 11/1975 | Germany | 4/606 |

*Primary Examiner*—Charles E. Phillips
*Attorney, Agent, or Firm*—Malin, Haley, DiMaggio & Crosby, P.A.

[57] ABSTRACT

A shower mounted body washing apparatus for assisting a user in cleansing various parts of the body. An adjustable shower mounted device having a plurality of rotating cleansing brushes and spray nozzles operated by water pressure for washing the body of a user is provided. An adapter mounted in a water supply line diverts water to an adjustable housing having a plurality of rotatable washing brushes mounted thereon. Water flow through the housing engages impellers thereby driving the washing brushes. A plurality of housing apertures produce spray for cleansing the user. A hand brush is provided for localized cleansing. The hand brush incorporates a single rotating brush driven by an impeller housed within the brush body and powered by water diverted by the supply line adapter. A soap dispenser selectively injects soap into the water supply for optimum cleansing.

7 Claims, 5 Drawing Sheets

SHOWER MOUNTED BODY WASHER

BACKGROUND OF THE INVENTION

1. Field of the Invention

This invention relates generally to bathing accessories, and more particularly to an adjustable shower mounted device having a plurality of rotating cleansing brushes and spray nozzles operated by water pressure for washing the body of a user.

2. Description of the Prior Art

Showering is a well known technique for cleaning the body. During a typical shower, a constant flow of clean water flows over the body, resulting in the removal of soap, suds, and body soil.

Many people experience difficulty reaching certain parts of the body, and in particular areas of the back, while showering. While attempting to properly cleanse their backs, bathers are often forced to twist in awkward positions, reaching around their chest and over their shoulders. This can be difficult for the elderly and impossible for those having physical disabilities.

The prior art reveals numerous devices designed to assist in the washing process. U.S. Pat. Nos. 5,228,165 issued to Westberry et al, 5,072,480 issued to Peters et al, 4,943,018 issued to Glaser et al, and 4,696,068 issued to Kenner all are directed to wall mounted back washing devices having fixed brushes that enable a person taking a shower or a bath to position their back against the device to assist in cleansing hard to reach areas. These devices, however, require the user to supply any washing motion by rubbing, either side to side, or up and down, against the fixed device.

U.S. Pat. Nos. 5,065,942 issued to Shannon, 4,271,543 issued to Martin, 4,228,557 issued to DeVivo et al, 4,171,094 issued to Halfen, 3,875,604 issued to Wurn et al, 3,724,760 issued to Smith, 2,697,839 issued to Jackson, and 1,758,115 issued to Kelly, are all directed to shower fixtures having either manual or automatic height adjusting features that enable the devices' cleansing means to move vertically relative to the user for cleansing hard to reach areas.

U.S. Pat. Nos. 5,153,962 issued to Ritter, 4,841,590 issued to Terry et al, 3,074,088 issued to Williams, are all directed toward powered rotating brushes. U.S. Pat. No. 2,730,737 issued to Herman is directed toward a shower mounted device having a vertically adjustable powered rotating brush for washing the body of a user.

While the aforementioned devices disclose various back washing devices for use in a shower, these devices have realized only limited acceptance in the market. All of the discovered art suffers limitations including; electrical power requirements, small brush size, fixed brushes or brush bristles that require the user to supply any necessary washing motion, lack of height adjustment, lack of water pressure adjustment, or bulky and complicated structure.

Thus, there exists a need for an uncomplicated shower mounted back washing device that easily mounts in a shower and provides a large cleansing surface having powered rotating brushes that do not require electricity and are easily adjustable so as to accommodate users of differing heights, and is capable of regulating water pressure. It is, therefore, to the effective resolution of the aforementioned problems and shortcomings that the present invention is directed.

SUMMARY OF THE INVENTION

The instant invention contemplates a shower mounted rotating brush body washer for use in a conventional shower to assist a user in washing hard to reach parts of the body, and particularly the back. The body washer essentially comprises: a pair of mounting rails disposed vertically along a shower wall, a housing movably mounted on the rails for easy height adjustment, a hose for supplying pressurized water, a soap dispenser, a plurality of water spray outlets, a plurality or washing brushes rotatably mounted on the housing exterior, at least one fluid impeller for converting water pressure for brush rotation, a hand held rotatable brush, and a means for regulating water pressure.

In a preferred embodiment, the instant invention incorporates a pair of spaced tubular guide rails mounted vertically on a shower or bath wall surface. The rails may be anchored by any one of a number of known fastening methods. Where the mounting wall has a smooth or polished surface, as with conventional tile, suction cups disposed on opposing rail ends may be employed in securing the rails. Where the mounting wall has greater surface texture, conventional fasteners may be employed in securing the rails. When properly mounted, the guide rails are securely fixed to the wall disposed vertically, spaced, and substantially aligned. The rails may be fabricated from rust resistant steel, polished aluminum, ceramic, or any other suitable material.

The guide rails support a back washer housing in slidable engagement therewith, such that the housing is vertically adjustable. A supply hose provides pressurized water to the housing interior. The housing may be generally box shaped having a front surface disposed toward the user. The front surface incorporates a plurality of apertures or nozzles forming water outlets for producing a spray or mist, and a plurality of rotating brushes for cleansing the user's body. Each brush is driven by a fluid impeller located in the housing interior, and in fluid communication with pressurized shower water traveling along a predefined path whereby water induced impeller rotation powers the rotating brushes. A manual control valve regulates water pressure within the housing thereby allowing the user to select desired brush rotation speed. The control valve also functions as a means for draining the housing between uses.

A hand held rotating brush accessory can be provided for localized use by the user. The hand brush comprises a molded body member incorporating an impeller and brush assembly connected to a pressurized water source using a conventional hose. A manual control valve regulates water flow to the hand held brush thereby allowing for adjustment of flow rate and associated brush rotation.

Using the instant invention involves setting the housing at a desired height, turning on the water supply thereby allowing water to flow into the housing where impeller contact initiates exterior brush rotation, adjusting the flow of water in the housing such that the desired brush rotation speed and spray flow rates are achieved, dispensing soap, placing the body in contact with the rotating brushes for cleansing, using the hand held brush accessory for localized use (optional), rinsing, and draining the housing when the washing process is complete.

In accordance with the instant invention, it is an object thereof to provide a body washing device for use with a conventional shower.

It is a further object of the present invention to provide a body washing device that easily adjusts to various heights.

Still another object of the instant invention is to provide and adjustable shower washing device having a plurality of rotating brushes powered by non-electric means.

A further object of the instant invention is to provide an adjustable rotating brush washing device having a hand held rotating brush accessory for localized use.

In accordance with these and other objects which will become apparent hereinafter, the instant invention will now be described with particular reference to the accompanying drawings.

DESCRIPTION OF THE PREFERRED EMBODIMENTS

Figure 1:
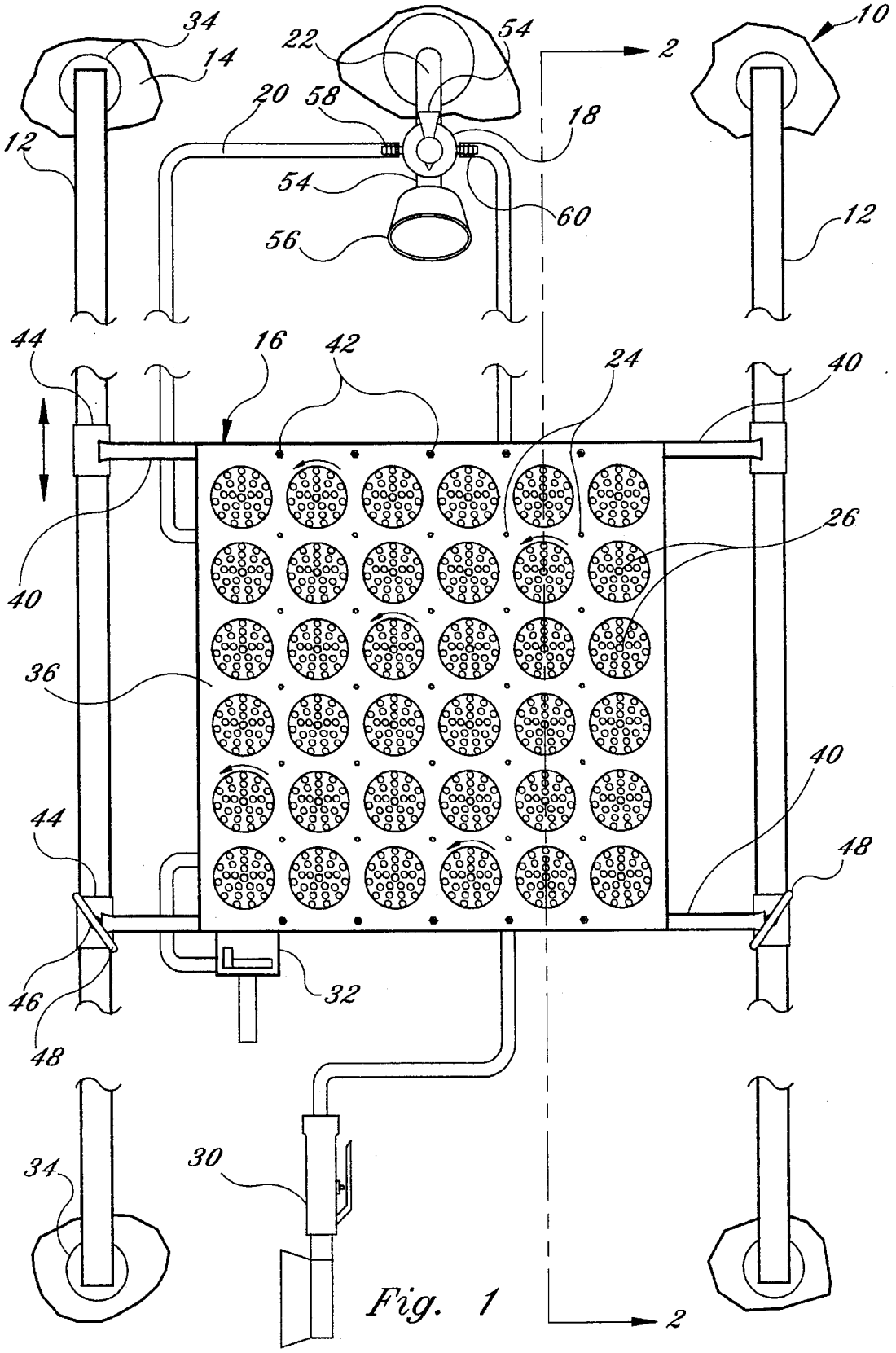
FIG. 1 shows a front perspective view of the instant invention.
Figure 2:
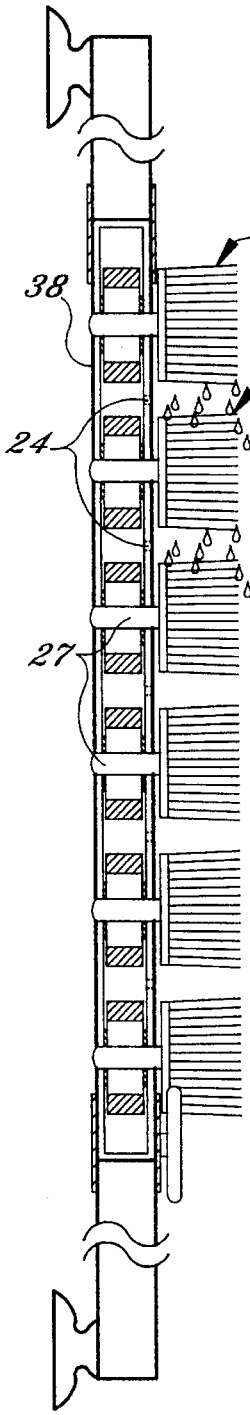
FIG. 2 shows a side sectional view of the instant invention.
Figure 4:
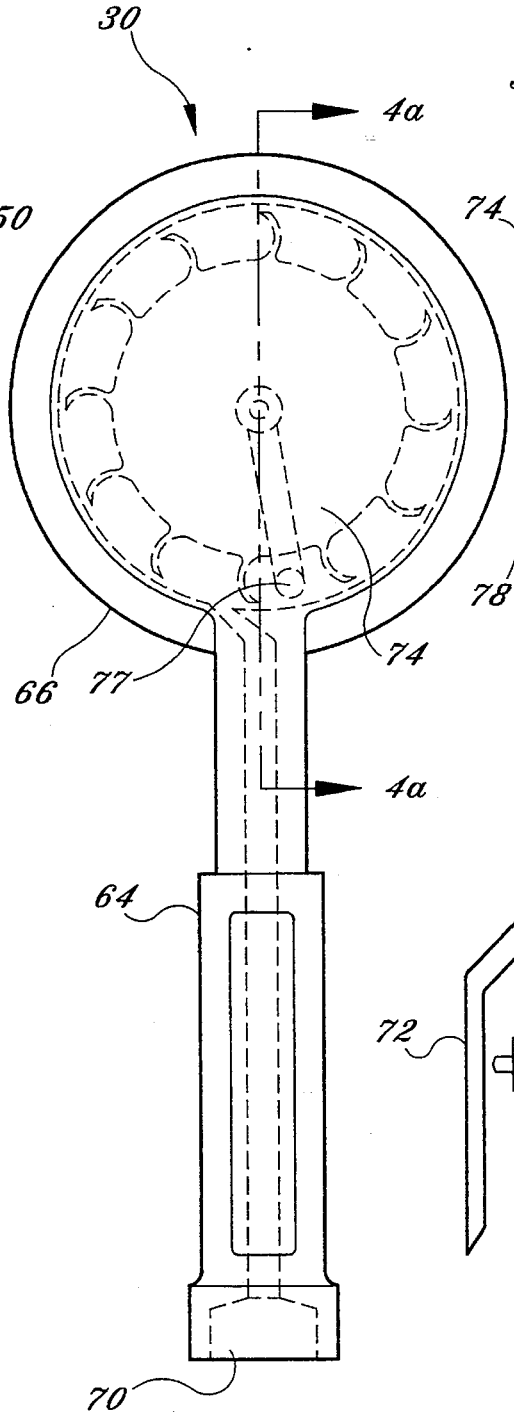
FIG. 4 shows back perspective view of the hand brush of the instant invention.
Figure 4A:
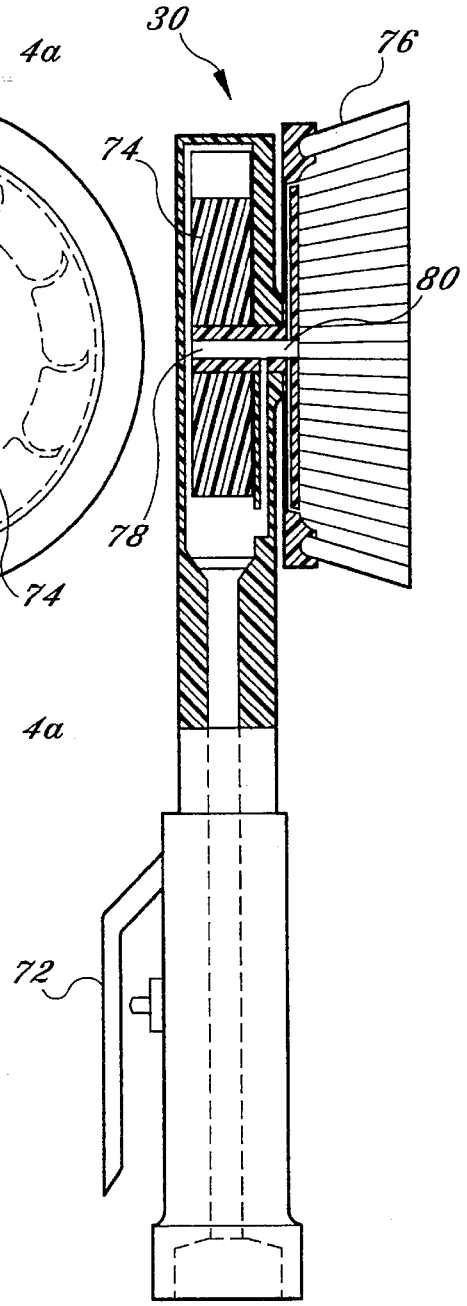
FIG. 4*a* shows a partial sectional side view of the hand brush of the instant invention.
Figure 3:
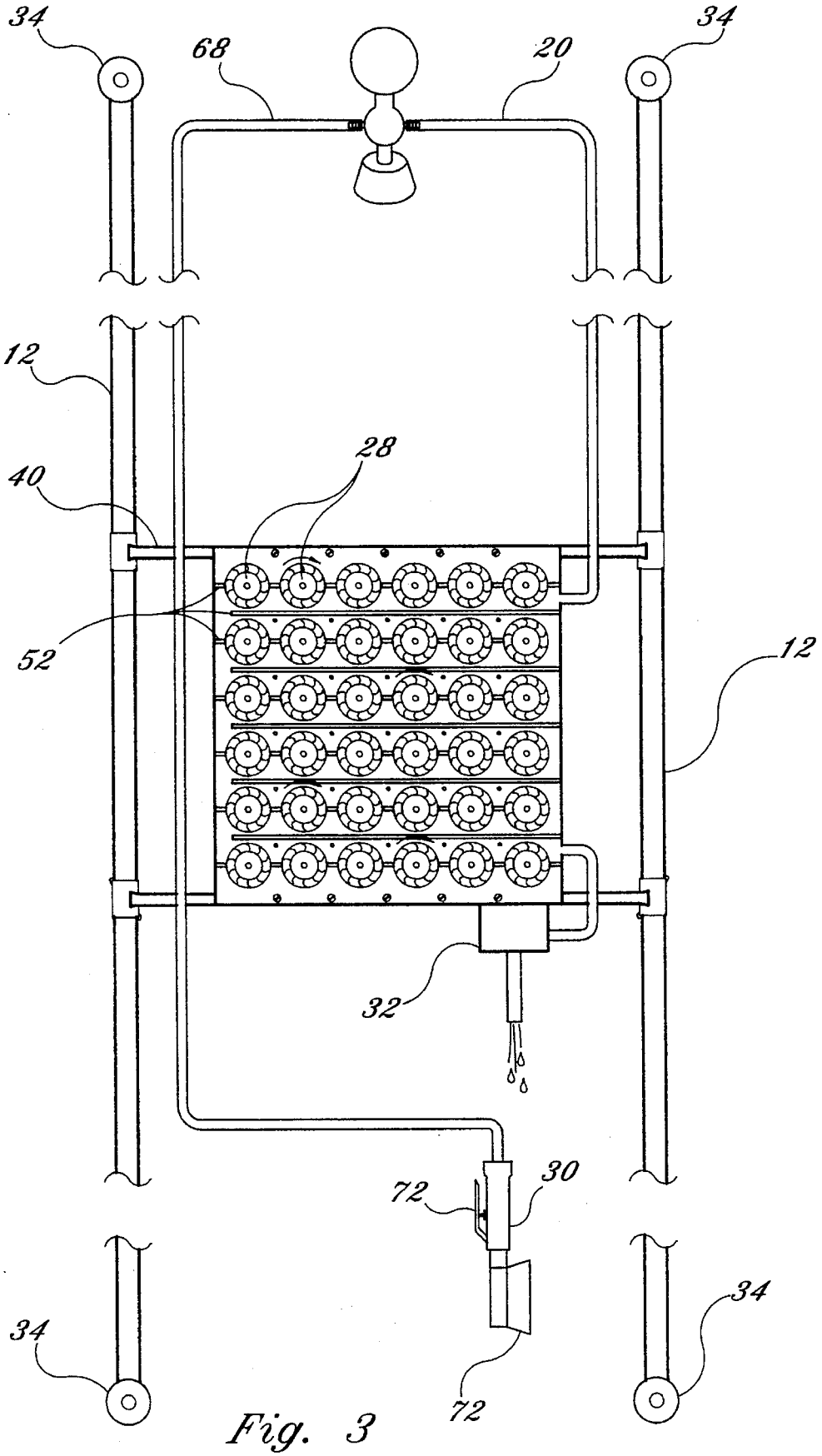
FIG. 3 shows a back perspective view of the instant invention.
Figure 5:
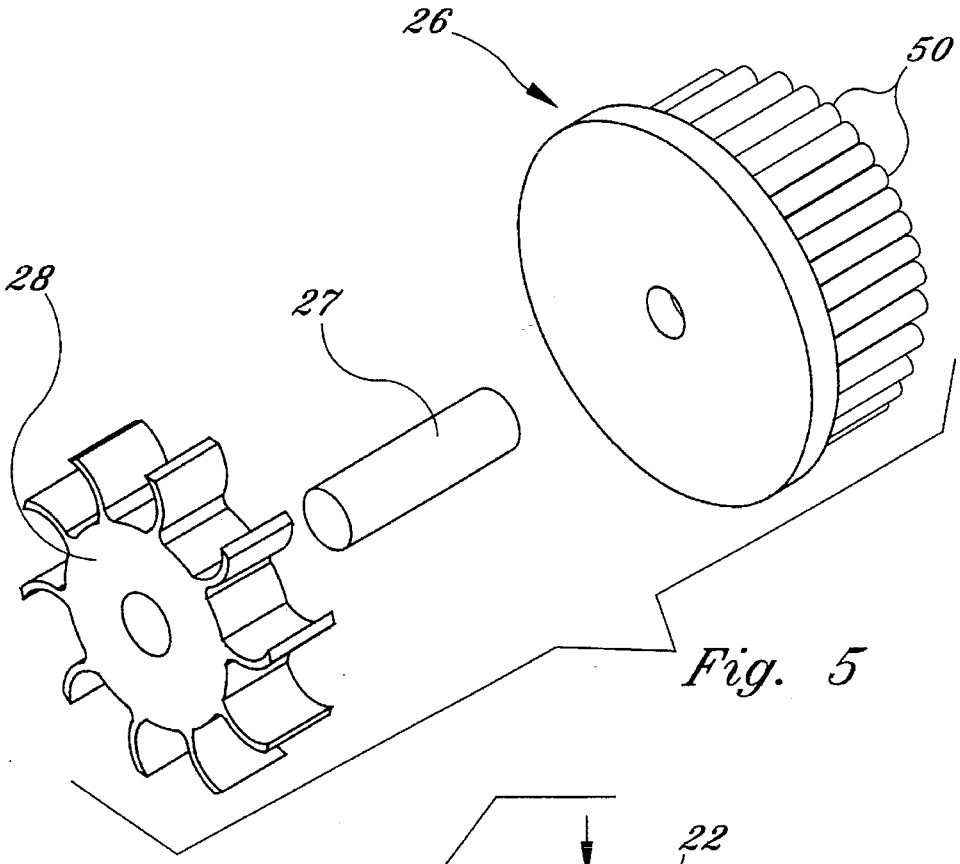
FIG. 5 is an exploded view of a typical impeller, shaft, and brush assembly.
Figure 6A:
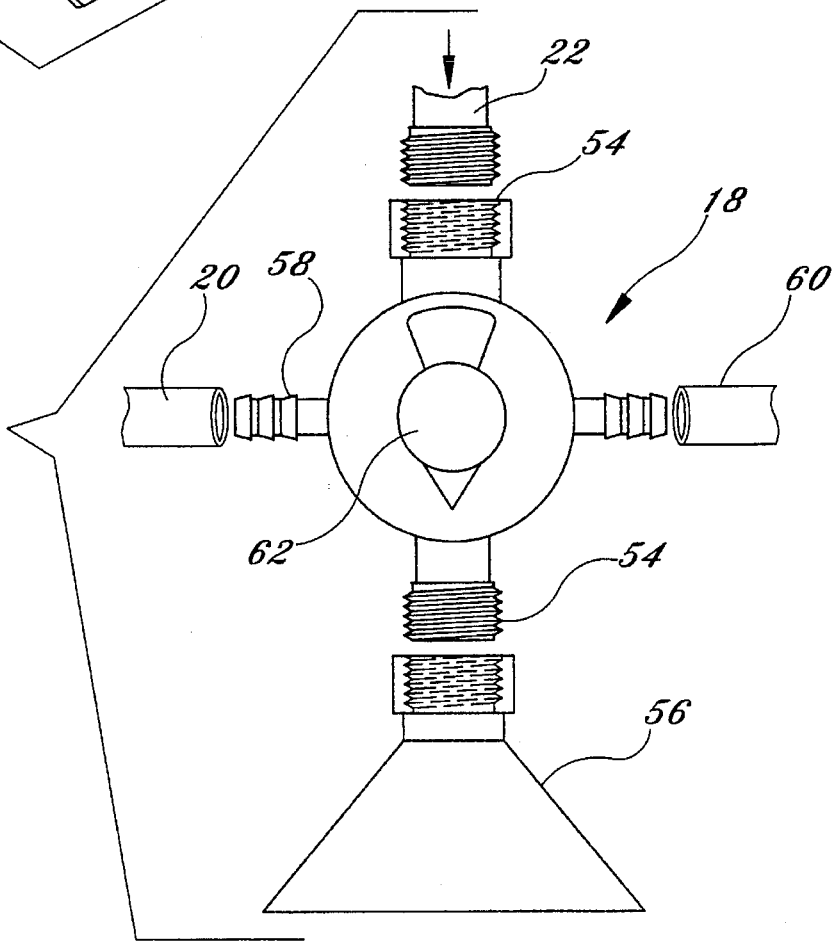
FIG. 6*a* is an exploded view of the shower head adapter installation.
Figure 6B:
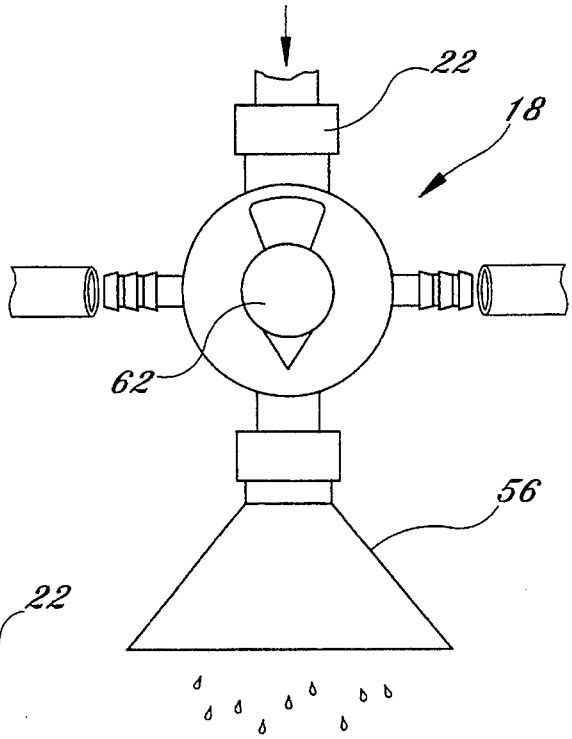
FIGS. 6*b*–6*d* detail water flow paths corresponding to user selected switch settings.
Figure 6C:
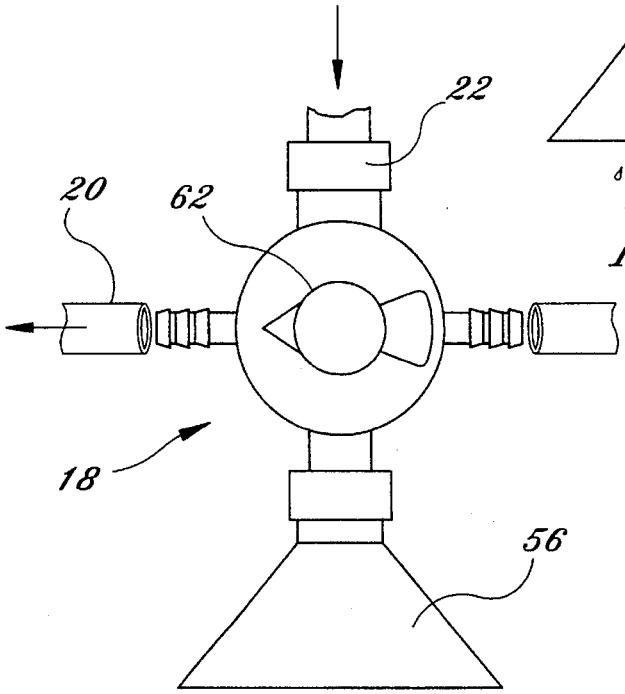
Figure 6D:
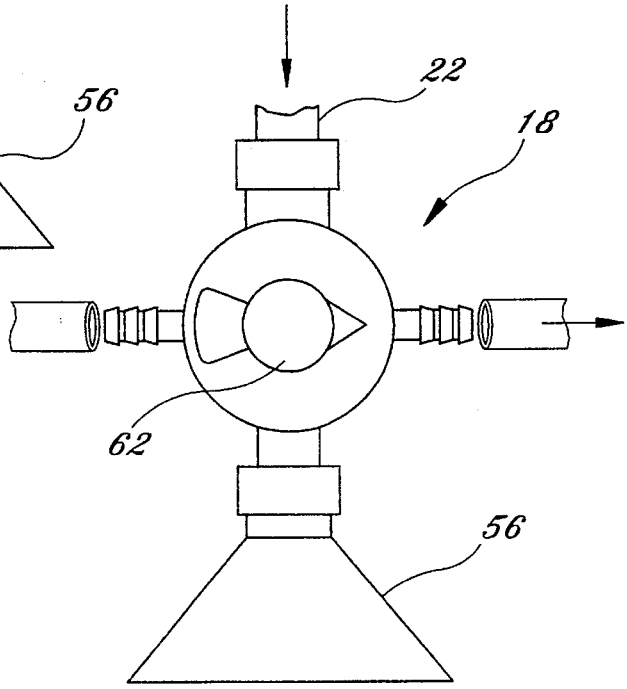

Referring now to the drawings, FIGS. 1 through 3 depict a preferred embodiment of the instant invention generally shown at 10, mounted in a shower. The body washer includes: a pair of mounting guide rails 12 disposed vertically along a shower wall 14, a washer housing 16 movably mounted on rails 12 for easy height adjustment, a shower head adapter 18, a hose 20 for supplying pressurized water from a shower head water source 22, a plurality of water spray outlets 24, a plurality or washing brushes 26 rotatably mounted on housing 16, a plurality of fluid impellers 28 for converting water pressure for brush rotation, a hand held rotatable brush 30, and a means for regulating water pressure 32.

The preferred embodiment contemplates a pair of spaced tubular guide rails 12 mounted vertically on a shower or bath wall 14 surface. Rails 12 may be anchored by any one of a number of known fastening methods. Where mounting wall 14 has a smooth or polished surface, as with conventional tile, suction cups 34 disposed on opposing rail ends may be employed in securing rails 12. Where mounting 14 wall has a course surface texture, conventional fasteners (not shown) may be employed in securing rails 12. When properly mounted, guide rails 12 are securely fixed to wall 14, disposed vertically, spaced, and substantially parallel. Rails 12 may be fabricated from rust resistant steel, polished aluminum, ceramic, or any other suitable material.

Washer housing 16 is formed by a box like housing shell having predetermined dimensions and a front surface 36 disposed facing the shower user, and a back surface 38 disposed facing mounting wall 14. In a preferred embodiment, the housing front surface 36 is substantially planar, however, the surface may be contoured. Housing 16 may be fabricated from clear plexiglass or acrylic as to enable the user to view the inner workings; however, housing 16 may also be fabricated from a variety of suitable materials including stainless steel. As best seen in FIG. 3, fabricating housing 16 from clear plexiglass enables a user to view the inner workings.

Housing 16 incorporates a pair of crossbars 40 rigidly attached using conventional fasteners 42 proximate the upper and lower housing ends. Crossbars 40 are comprised of elongated tubular members, having smooth bore apertures 44 fitted with suitable bushings, at opposing member ends. Housing 16 thus has upper and lower apertures 44 disposed in axial alignment and sized to accommodate guide rails 12 disposed therethrough such that housing 16 exists slidably engaged with rails 12 thereby allowing vertical adjustment. Lower crossbar ends each also incorporate threaded aperture 46 having a center axis perpendicular to smooth bore apertures 44, and accommodating a locking set screw 48 for locking housing 16 at a desired height.

Housing 16 further incorporates a plurality of rotatably mounted brushes 26 existing on housing front surface 36. Brushes 26 have a plurality of conventional washing bristles 50 for washing parts of a user's body. Brushes 26 are each connected by a shaft 27 to impellers 28 located within the housing 16 interior. In an alternate embodiment, shafts 27 may be hollow and incorporate a shaft aperture (not shown) for directing a spray or mist of water directly from brushes 26.

The housing 16 interior incorporates partitions 52 for directing water flow past impellers 28 such that impellers 28 cause brushes 26 to rotate. The instant invention contemplates configuring housing partitions 52 such that brushes 50 rotate in a pre-determined direction; alternately housing partitions 52 may be configured such that brushes 50 rotate in alternating clockwise and counter clockwise directions. Partitions 52 may be contoured so as to direct water flow for maximum impeller efficiency.

Housing front surface 36 further incorporates a plurality of spray apertures 24. Spray apertures 24 allow a regulated flow of water to exit housing 16 thereby producing a continuous spray or mist of water. Although the preferred embodiment incorporates a plurality of spray apertures 24, the invention also contemplates the use of a single adjustable spray aperture. Furthermore, the invention contemplates directing water A shower head adapter 18 installed in the main water supply line 22 provides water outlets for supplying water to the instant invention. Shower head adapter 18 comprises a generally t-shaped fitting incorporating a pair of threaded ends 54 such that adapter 18 may be installed in-line in the shower head water supply line 22 upstream of shower head 56. Adapter 18 further incorporates a pair water outlets 58 and 60 for selectively supplying water for use with the instant invention. An adapter selection switch 62 enables a user to selectively divert water from flowing out of shower head 56 in a conventional manner, to flowing out of outlets 58 or 60 for use with the instant invention. Adapter 18 may further allow for water to flow through shower head 56 and outlets 58 and/or 60 simultaneously.

A supply hose 20 is connected at one end to adapter outlet 58, and connected at the opposite hose end to housing 16 such that when switch 62 is properly positioned, housing 16 is in fluid communication with the main water supply thereby allowing water to flow into the housing 16 interior wherein said water flow follows a path defined by housing partitions 52, causing impellers 28 and brushes 26 to rotate.

Housing 16 also incorporates a valved outlet 32, located proximate the housing 16 bottom for regulating water flow. Valve 32 may be selectively modulated from full closed to full open, thereby regulating the flow of water exiting housing 16. When water is supplied to housing 16 and valve 32 is in a closed position, housing 16 is pressurized and the flow of water exiting spray outlets 24 is maximized, while brush 26 rotational speed is minimized. In contrast, when water is supplied to housing 16 and valve 32 is in an open position, water is allowed to exit housing 16 through valve outlet 32 thereby maximizing water flow rate through housing 16 resulting in maximum brush rotation and minimum flow through spray outlets 24. Thus, outlet valve 32 functions so as to allow a user to adjust spray flow rate and brush rotational velocity as desired. Valved outlet 32 may also incorporate a hose for allowing the user to rinse the instant invention after use with water.

The invention further contemplates a soap dispenser (not shown) in fluid communication with housing 16 whereby soap may be selectively dispensed for use with the instant invention. The invention contemplates mounting the soap dispenser on said housing 16, and providing a switch whereby a user may selectively dispense soap for alternating washing and rinsing cycles.

The instant invention also contemplates a hand brush, generally indicated 30 and having a handle section 64 and a brush head section 66. Hand brush 30 is in fluid communication with main water supply line 22 via adapter outlet 60 and hose 68, such that when adapter switch 62 is selectively positioned water flow is directed from main supply line 22 through hose 68 to hand brush 30. Brush handle section 64 further incorporates an aperture 70, and a hand actuated normally closed valve, generally designated 72 that enables a user to regulate water flow to head section 66. Head section 66 further houses an impeller 74 connected to an exterior mounted rotatable brush 76 by a tubular shaft 78, such that water flowing through handle aperture 70 drives impeller 74 thereby rotating brush 76. Tubular shaft 78 further provides a water outlet 80 for producing spray. Thus, hand held brush 30 enables a user to receive the benefit of the cleansing action of the instant invention by applying brush to localized parts of the body.

To use the instant invention, the housing 16, guide rails 12, shower head adapter 18, and hoses 20 and 68 are installed as previously described. Housing 16 is positioned at a user selected height, by raising or lowering such that cross bar apertures 44 slide along rails 12, and is locked in place using set screws 48. The shower is turned on in a conventional manner such that water begins to flow out of shower head 56 Adapter switch 62 is then positioned so as to divert water through outlet 58 to housing 16 via hose 20. Water travels inside housing 16, guided by partitions 52, and engages impellers 28 thereby causing brushes 26 to rotate; water also exits housing 16 through apertures 24 thereby producing a spray or mist covering the user. Water that does not exit spray apertures 24 exits housing 16 via valved outlet 32 and is drained through the shower drain (not shown). It should be apparent that when outlet valve 32 is fully open, housing flow, and hence brush rotation is maximized. By modulating outlet valve 32 to its closed position, housing flow and brush rotation is minimized, while the resulting pressure increase maximizes spray exiting through spray outlets 24.

Cleansing is accomplished when the user positions his body in contact with rotating brushes 26. Further, localized cleansing is accomplished by positioning adapter selection switch 62 such that water is diverted to hand brush 30 through hose 68 via adapter outlet 60. Hand brush 30 is activated by manipulating hand operated normally closed valve 72 such that water is allowed to flow through handle aperture 70 to brush head section 66. Water entering head section 66 engages impeller 74 thereby rotating impeller 74 and causing brush 76 to rotate. Brush head section 66 further incorporates an aperture 77 for allowing water to flow to a brush head outlet 80 via tube 78 resulting in a spray or mist for washing.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A body washing apparatus, for use with a conventional shower, for washing the body of a user comprising:

a pressurized water supply line;

a housing having an interior, a top end, a bottom end, and a front surface, said front surface having a plurality of washing brushes rotatably mounted thereon;

said housing further incorporating a water inlet, a water outlet, and a plurality of spray nozzles on said front surface, and located intermediate said inlet and outlet;

said housing having an interior partition defining a water flow path through said housing;

a pair of elongated mounting guide rails, said guide rails each having a first end and a second end, and a means for attaching said rail ends to a shower wall such that said guide rails exist rigidly attached to said shower wall, disposed vertically and substantially parallel;

said housing having a pair of elongated mounting members, rigidly attached proximate said housing top and bottom ends, said members each having opposing ends, each member end incorporating generally circular aperture sized and aligned so as to accommodate one of said guide rails therein, such that said housing exists in slidable engagement with said mounting guide rails;

water flow diverting adapter for selectively diverting water flow from said water supply line, said adapter having a first outlet, and a user operated switch for diverting water flow through a said first adapter outlet;

hose for supplying diverted water from said first adapter outlet to said housing water inlet;

a plurality of impellers, rotatably mounted within said housing, and adapted to be driven by water from said pressurized water source for driving said washing brushes, said impellers being positioned intermediate said water inlet and said water outlet and adapted to receive water flowing through said housing;

housing outlet valve for regulating housing outlet water flow thereby regulating said washing brush rotation.

2. A body washing apparatus, as defined in claim 1 further comprising a valve means for regulating housing water flow thereby regulating said washing brushes rotational velocity.

3. A body washing apparatus, as defined in claim 1, further incorporating a hand held brush comprising:

a body member having at least one brush element rotatably mounted thereon;

said body member incorporating a water inlet and a spray nozzle outlet, and an impeller operatively connected to said brush element, said impeller adapted to be driven by water for rotatably driving said brush element, said impeller being positioned within said housing and adapted to engage water flowing from said hand brush water inlet through said body member to said spray nozzle outlet where said water is dispensed therethrough;

said water flow diverting adapter having a second water outlet;

a second hose for supplying water from said pressurized water source to said body inlet via said second adapter outlet;

a normally closed valve for regulating water flow through said body member, and;

a trigger, pivotally connected to said body member, for actuating said valve thereby allowing water to flow through said hand held brush body.

4. A body washing apparatus as defined in claim 3, wherein said housing incorporates a means for selectively dispensing soap into water flowing through said housing interior.

5. A body washing apparatus as defined in claim 4, wherein said means for attaching said rail ends to said shower wall comprise suction cups.

6. A body washing apparatus according to claim 1, wherein said plurality of impellers disposed adjacent to an associated washing brush and operatively associated with said adjacent washing brush by a shaft member, wherein water flowing through said housing causes said impellers to rotate which in turn causes said plurality of washing brushes to rotate.

7. A body washing apparatus according to claim 1, wherein said apparatus having a plurality of partitions, said partitions configured such that said plurality of washing brushes rotate in a pre-determined direction.

* * * * *